US006766700B2

(12) United States Patent
Hsien

(10) Patent No.: US 6,766,700 B2
(45) Date of Patent: Jul. 27, 2004

(54) WRENCH HAVING TORQUE INDICATOR

(76) Inventor: Chih-Ching Hsien, No. 367, Pei Yang Rd., Fen Yuan, Taichung (TW)

( * ) Notice: Subject to any disclaimer, the term of this patent is extended or adjusted under 35 U.S.C. 154(b) by 0 days.

(21) Appl. No.: 10/229,087

(22) Filed: Aug. 28, 2002

(65) Prior Publication Data

US 2004/0040388 A1 Mar. 4, 2004

(51) Int. Cl.[7] ..... B25B 23/14
(52) U.S. Cl. ..... 73/862.21
(58) Field of Search ..... 73/862.21, 862.27, 73/862.28, 862.25

(56) References Cited

U.S. PATENT DOCUMENTS 3,581,606 A * 6/1971 Grabovac ..... 81/483
4,545,267 A * 10/1985 Shumway ..... 81/57.29
4,641,538 A * 2/1987 Heyraud ..... 73/862.26
4,800,786 A * 1/1989 Arnold et al. ..... 81/121.1

* cited by examiner

*Primary Examiner*—Max Noori

(57) ABSTRACT

A wrench includes a handle having an engaging end at one end of the handle and a sleeve is slidably mounted to the handle. A tension gauge is received in the handle and connected to an electronic display screen. The display screen is exposed to an outer surface of the handle and can be covered by the sleeve.

1 Claim, 7 Drawing Sheets

WRENCH HAVING TORQUE INDICATOR

FIELD OF THE INVENTION

The present invention relates to a wrench includes a slidable sleeve on the handle of the wrench and a tension gauge received in the handle so as to display the value of torque on an electronic display screen.

BACKGROUND OF THE INVENTION

A conventional wrench that can display the value of torque is shown in FIG. 7 and generally includes a handle 100 with an engaging end 200 at one end of the handle 100 and a spring (not shown) is received in the handle 100. The value of the torque that the wrench outputs is displayed by way of bending the spring. Nevertheless, the fatigue of the spring appears after being used for a period of time and the spring cannot reflects a correct value of the torque that the wrench outputs. Another conventional wrench is shown in FIG. 8 and includes an electronic display screen 300 on an outer surface of the handle. An inherent shortcoming of the wrench is that the exposed screen 300 restricts the space that the wrench can be used, and the screen 300 could be damaged by impact of subjects.

The present invention intends to provide a wrench that has a slidable sleeve which may cover the electronic screen so as to protect the screen.

SUMMARY OF THE INVENTION

In accordance with one aspect of the present invention, there is provided a wrench which comprises a handle having an engaging end at one end of the handle and a tension gauge is received in the handle and connected to an electronic display screen which is exposed to an outer surface of the handle. A sleeve is slidably mounted to the handle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
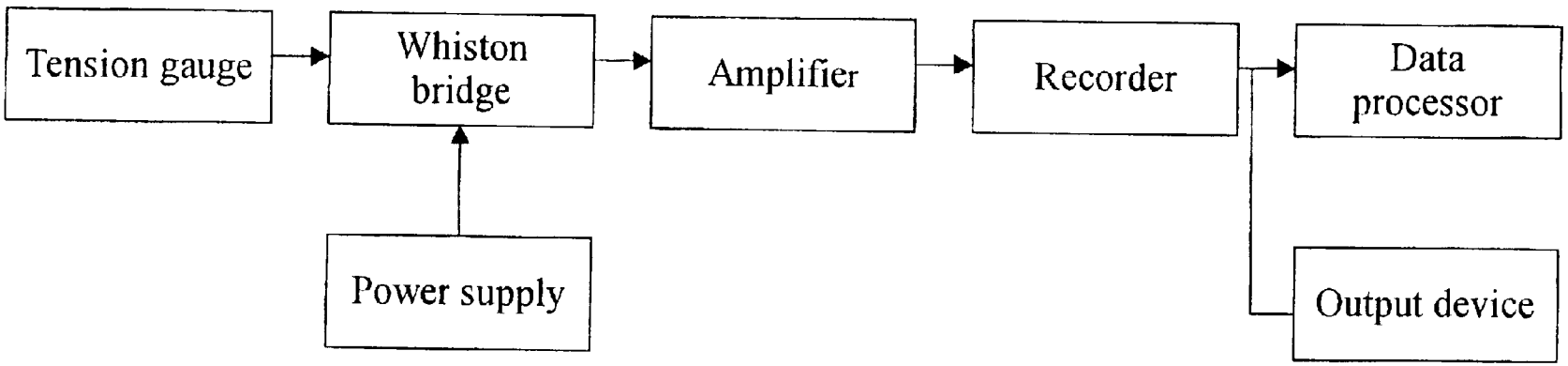
FIG. 1 is a diagram to show the connection between parts of the electronic display screen of the wrench of the present invention.

Referring to FIGS. 3 to 6, the wrench of the present invention comprises a handle 10 having two engaging ends such as an open end 12' and a box end 12 at two ends of the handle 10 and a tension gauge 20 is received in the handle 10. A display casing 30 is received in the handle 10 and includes an electronic display screen 31 and buttons 32, both of the display screen 31 and buttons 32 are exposed to an outer surface of the handle 10 and the display screen 31 is in flush with the outer surface of the handle 10. The display casing 30 is connected to the tension gauge 20 so that when the tension gauge 20 is applied by a torque, the value of the torque is displayed in the display screen 31. A sleeve 40 is slidably mounted to the handle 10 and can be slid along the handle 10 so as to cover the display screen 31 and buttons 32. Therefore, the display screen 31 and buttons 32 can be protected from being damaged.

Figure 2:
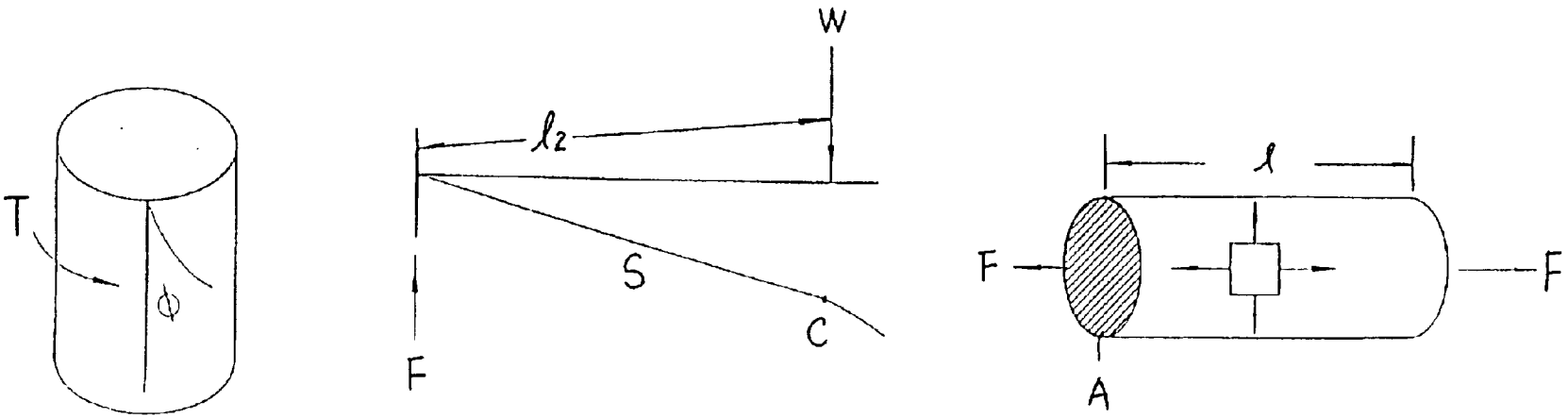
FIG. 2 shows the deformation of material applied by a force and a torque.
Figure 3:
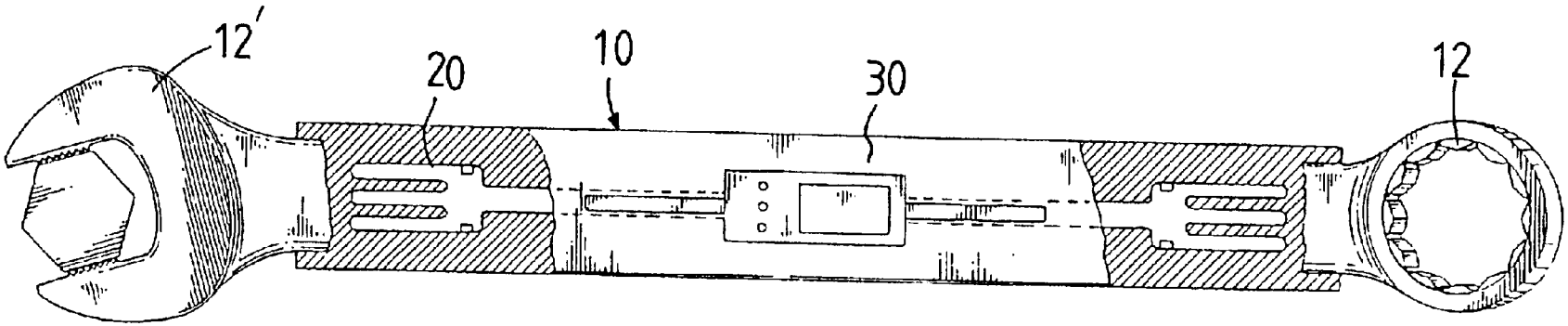
FIG. 3 is a cross sectional view to show the wrench of the present invention.
Figure 5:
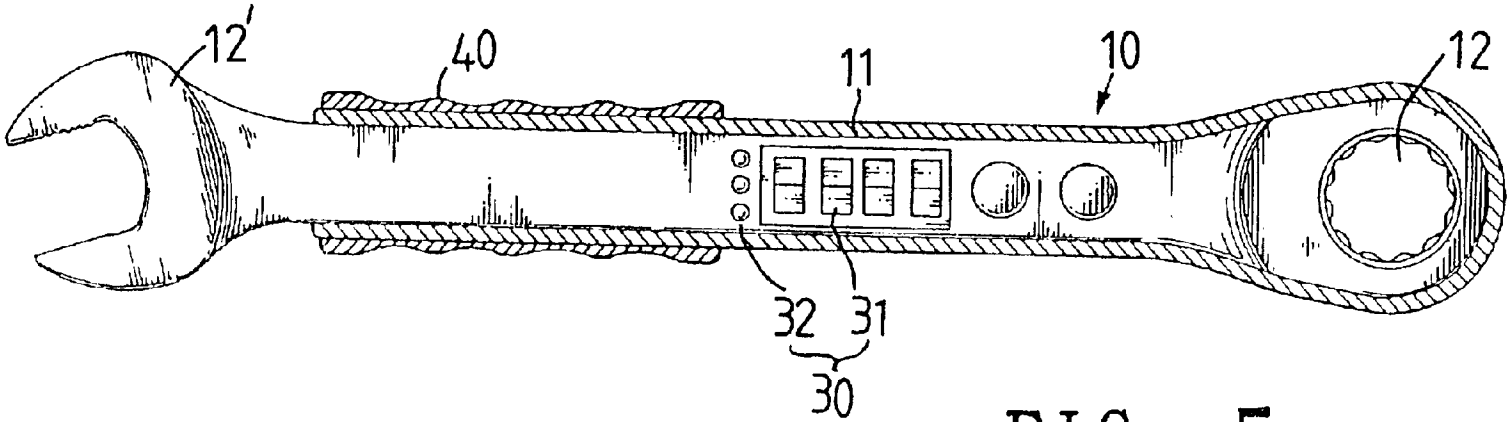
FIG. 5 shows display screen and buttons on the handle of the wrench of the present invention.
Figure 4:
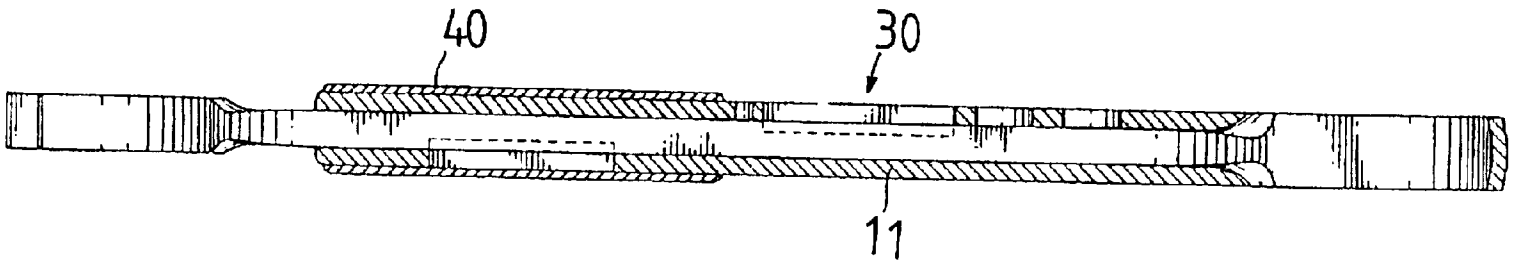
FIG. 4 is a side cross sectional view to show the wrench of the present invention.
Figure 6:
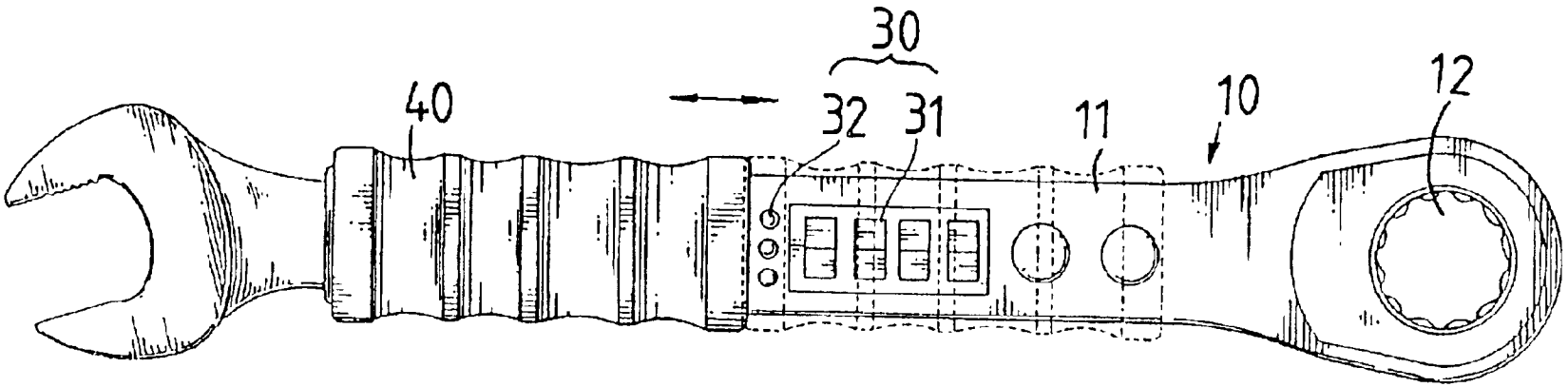
FIG. 6 shows a sleeve is slidably mounted to the handle of the wrench.
Figure 7:
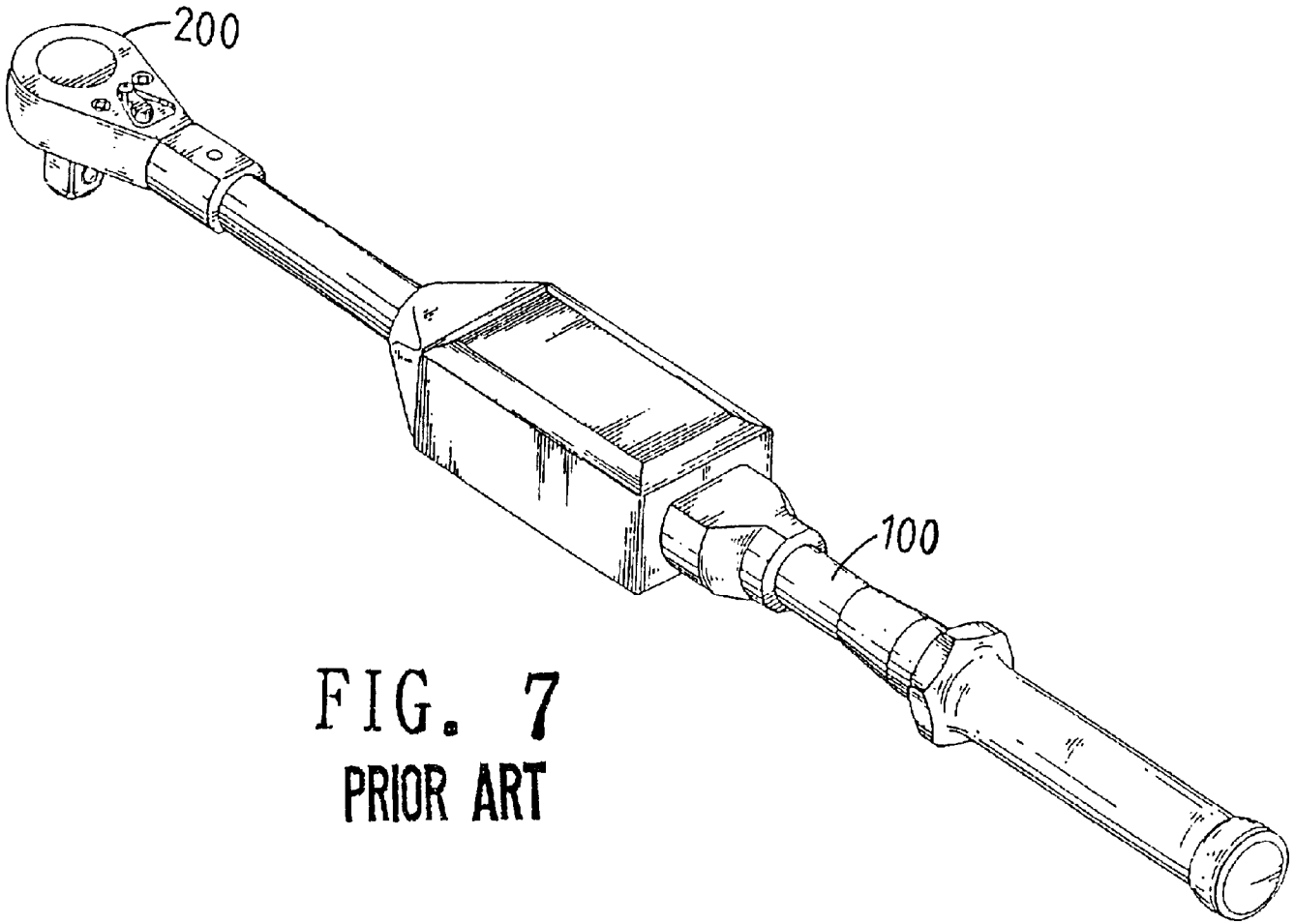
FIG. 7 PRIOR ART
FIGS. 7 and 8 are perspective views to show two conventional wrenches.
Figure 8:
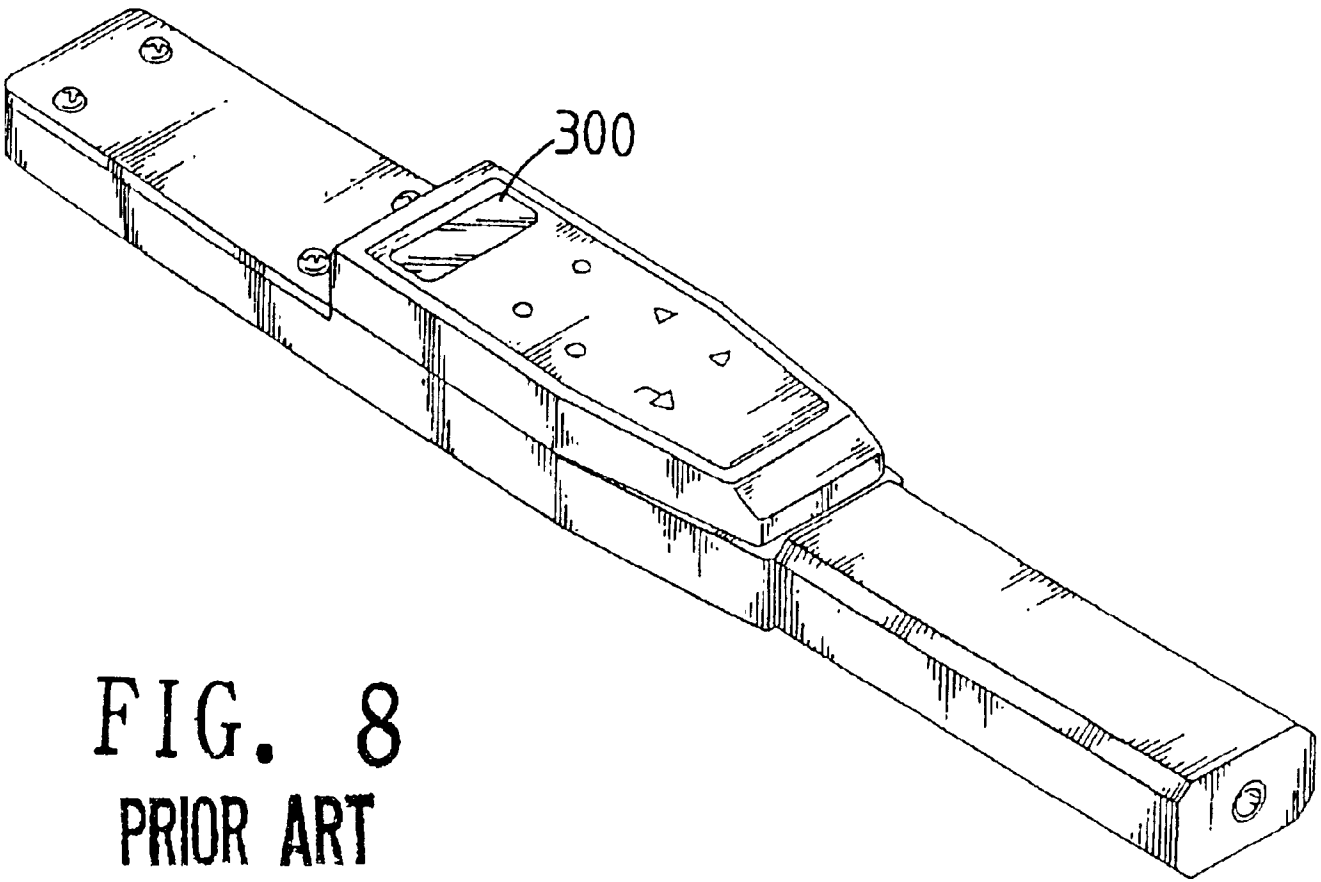
FIG. 8 PRIOR ART

Referring to FIG. 1 which shows the blocks of the circuit in the display case 30 and FIG. 2 shows some basic theory of torque. S represents a length of an arc and 12 represents the unit length of an object that is applied by a force, and C represents the point that the force applies to. After the force is applied, $S>\delta 2$, the tension gauge 20 is deformed and sends a signal via the Whiston Bridge. Similarly, when a cylindrical object is applied by a torque and twisted an angle of $\phi$, it sends a signal by changing the voltage. The resistance $R=\rho xl/A$, wherein A represents a unit area. The change of the resistance is transferred inot output voltage which is amplified by an amplifier and processed by a data processor so as to transfer the analog signals into digital signals which can be shown on the display screen 31

While we have shown and described the embodiment in accordance with the present invention, it should be clear to those skilled in the art that further embodiments may be made without departing from the scope of the present invention.

What is claimed is:

1. A wrench comprising:

a handle having an engaging end at one end of the handle and a tension gauge received in the handle, an electronic display screen connected to the tension gauge and exposed to an outer surface of the handle, the electronic display screen being in flush with the outer surface of the handle, and a sleeve slidably mounted to the handle and the electronic display screen being hidden by the sleeve when the sleeve is slid to a position.

* * * * *